United States Patent [19]

Maeda

[11] Patent Number: 4,705,337

[45] Date of Patent: Nov. 10, 1987

[54] ELECTRICAL CONNECTOR HOUSING

[75] Inventor: Akira Maeda, Shizuoka, Japan

[73] Assignee: Yazaki Corporation, Tokyo, Japan

[21] Appl. No.: 849,188

[22] Filed: Apr. 7, 1986

[30] Foreign Application Priority Data

Apr. 8, 1985 [JP] Japan ..... 60-72801

[51] Int. Cl.[4] ..... H01R 11/00

[52] U.S. Cl. ..... 439/595; 439/848; 439/748

[58] Field of Search ..... 339/59 R, 59 M, 61 R, 339/61 M, 217 S

[56] References Cited

U.S. PATENT DOCUMENTS 4,114,971 9/1978 Heimbrock ..... 339/59 R
4,253,718 3/1981 Bungo ..... 339/59 R
4,323,296 4/1982 Andoh ..... 339/217 S

*Primary Examiner*—Gil Weidenfeld
*Assistant Examiner*—Paula A. Austin
*Attorney, Agent, or Firm*—Murray and Whisenhunt

[57] ABSTRACT

In an electrically insulated housing for an electrical connector which is to accommodate terminals in its passages, rear holders are provided over the housing for the prevention of rearward withdrawal movements of the terminals, in addition to retainers which are provided in the housings. Each rear holder has one or a plurality of projections in series which are engageable with the terminals by their substantially vertical displacement accompanied with the flection of hinges of an angle of less than 90°, viz., about 45°, which hinges connecting each projection to the housing with comparatively narrow and long extensions.

9 Claims, 4 Drawing Figures

ELECTRICAL CONNECTOR HOUSING

BACKGROUND OF THE INVENTION

This invention relates to a housing in an electrical connector, and more particularly the housing provided with a rear holder which can prevent the rearward withdrawal movement of a terminal in a housing passage by sharing the retention of the terminal with conventional retainers, and which is characterized by its easy and steady operation and by its efficiencies for sensing incomplete insertion of the terminal into the housing passage.

In general, an electrical connector comprises an electrically insulated housing having a plurality of passages, each of which is to accommodate a terminal therein and provided with a resilient retainer, the terminal being engageable with the retainer upon the insertion of terminal into the passage. However, it has been often found that when a lead connected to the terminal is pulled rearwardly, the retainer is subjected to damages and the terminal is withdrawn rearwardly from the passage. In order to prevent this, a device was proposed such as seen in Japanese preliminary patent publication No. 57-52715.

Such a device is illustrated in FIG. 4, an explanatory perspective view, wherein a flap d with a plurality of projections c, each having a face f, is connected to the housing a by a hinge e. Each of the projections c faces a respective hollow b provided in an upper wall of the housing a and by virtue of the hinge e the flap d may be closed over the hollows b, if desired. When the flap is closed, its projections c abut against the terminals, whereby the terminals are prevented from rearward withdrawal movements, in addition to the retention thereof by the retainers.

However, since the closing and opening movement of such device is relied upon resiliency given by the hinge e of a short length, a large bending motion of about 90° of the flap d which extends from the housing a vertically at a right angle, and a locking force given on the flap d in the direction of insertion of the terminals, the hinge e shall noticeably be weakened upon a repetition of closing and opening operations and be shorn off sometimes. Since the vertically standing flap is pressed from its back as mentioned above, it is not so easy to close it whereby operation efficiency becomes low. And, since an excessive force is apt to be applied on the flap inherently to its structure, the terminals would be damaged when they are not completely inserted into passages.

BRIEF SUMMARY OF THE INVENTION

In view of the above, it is the object of this invention to provide a housing for an electrical connector, which is free from the above-mentioned drawbacks of conventional connector housings, rear holders of which are easy to operate, and which can prevent an incomplete insertion of terminals into the passages before such incomplete insertion happens and in which a connection between the rear holder and the housing is strong enough to stand repeated operations thereof.

The housing for electrical connectors made in accordance with this invention is accordingly characterized in that the rear holder is releasably fitted to windows which are provided in an outer circumferential wall of the housing so as to open in the terminal passages, and that the holder is able to engage with the terminals for the prevention of their rearward withdrawal movements by means of projections which are connected to rims of the windows through resilient and elongated hinges.

On account of novel strcutures of the housing of this invention summarized above, and since the length of hinges can be made considerably longer in this invention as the rear holder thereof is not made from such part of the wall which closes entirely the window, but is consisted of projections of a dimension smaller than said window but nearly equal to an inner window or slot through which the projections abut against terminals and of the hinges which extend from rims of the window and are connected to the bottom parts of the projections, stress exerted on the hinges and projections with the closing and opening operation of the rear holder can be dispersed; and the hinges shall not be worn easily and have a longer life as the projections can be fitted and removed from their operative positions by their moderate movements through the windows, which movements are substantially vertical with the corresponding movements of hinges of an angle less than 90° viz., about 45°.

The rear holder made in accordance with this invention can accordingly be operated easily by a comparatively light force towards and from the windows, and such operation under a light force shall not do damage to the terminals even when they are incompletely inserted in the passages, while the incomplete insertion of terminals can be detected easily in this invention housing.

BRIEF DESCRIPTION OF THE DRAWING

In the accompanying drawing in which an embodiment of this invention is illustrated.

DETAILED DESCRIPTION OF THE EMBODIMENTS

This invention is explained hereinunder further in detail, with reference to the accompanying drawing.

Figure 1:
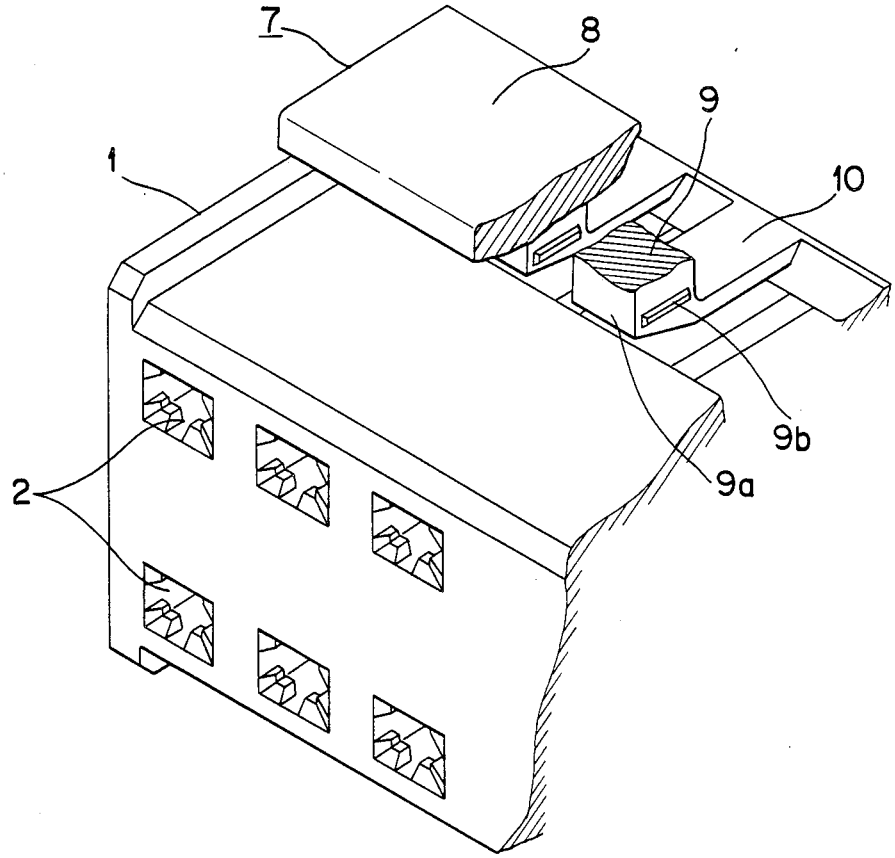
FIG. 1 is a perspective view of main portions of an electrical connector housing made in accordance with this invention.
Figure 2:
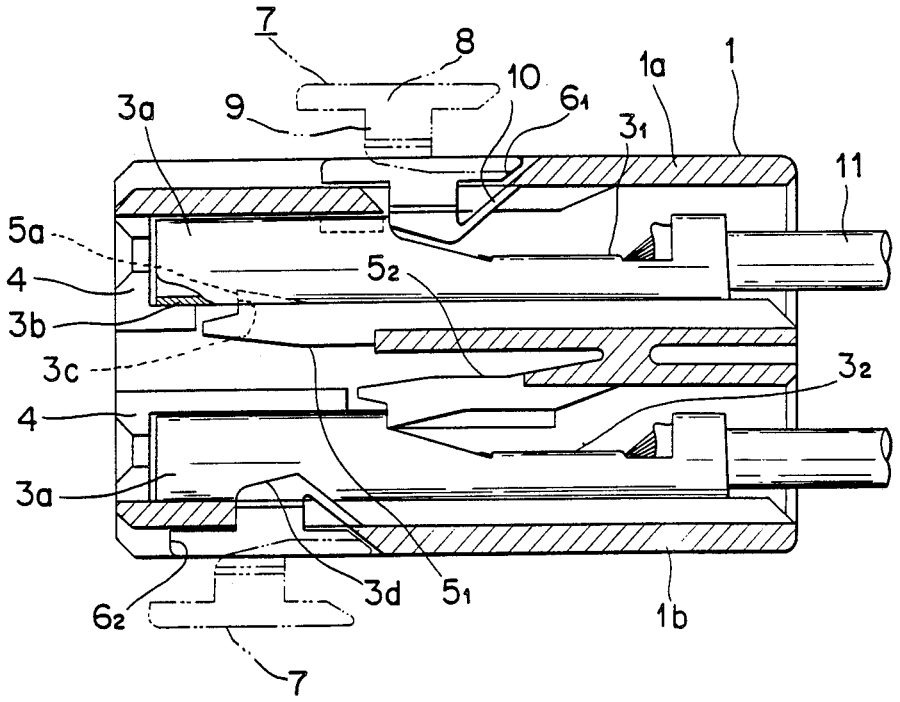
FIG. 2 is a vertical sectional view of the housing which has been completely assembled with retainers and terminals.
Figure 4:
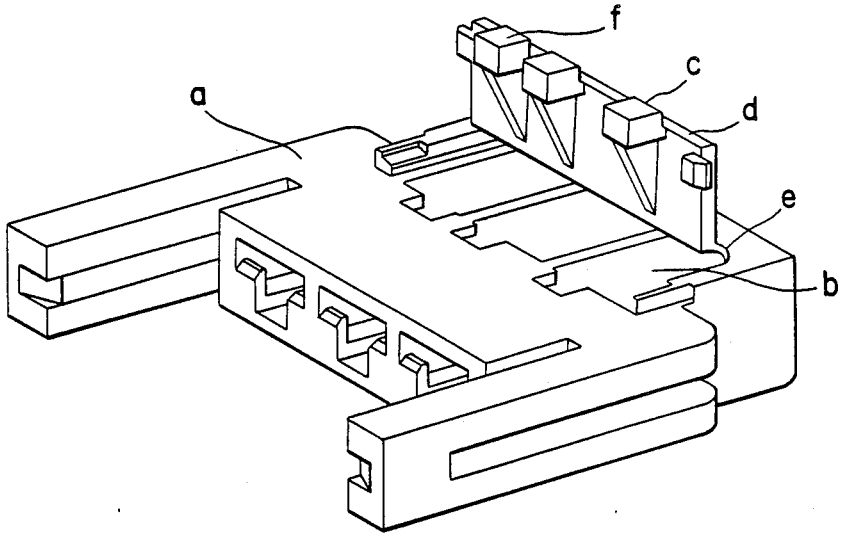
PRIOR ART FIG. 4
FIG. 4 is an explanatory perspective view showing an example of conventional housings.

In FIGS. 1 and 2, an electrically insulated housing 1 has a plurality of terminal passages 2 which run in parallel with each other and are arranged in upper and lower rows. Each passage is provided at its front end with wall projections 4 which prevent a terminal $3_1$, $3_2$ from passing through the passage in the forward direction. Resilient retained arms $5_1$, $5_2$ each having at a front end thereby shoulder 5A. The shoulder 5A of the upper retainer 5, projects into the upper passage and is engageable with slot **3*c* provided frontward on a bottom plate 3*b* of a mating female contact portion 3*a* of the terminal 3**, while the shoulder of the lower arm $5_2$ projects into the lower passage and is engageable with a rear end of the portion $3_a$ so that they prevent the terminals from rearward withdrawal movement by their respective engagement at the shoulders either with the engagement slot $3_c$ or the rear end of the portion $3_a$.

The housing 1 is provided at upper and lower outer circumferential wall portions $1_a$, $1_b$ with windows $6_1$, $6_2$ which opens to the terminal passages, and to which rear holders 7 are insertedly fitted. The window $6_1$ opens more particularly adjacently to and rearward of a location where the rear end of the female mating portion $3_a$ occupies when the terminal is completely inserted into the passage 2, while the window $6_2$ opens toward a location where an engagement slot $3_d$ which is provided on the bottom plate $3_b$ of terminal 3 will occupy when the terminal is inserted in the passage.

Each rear holder 7 has, as best shown in FIG. 1, a lid member 8 which completely covers the window $6_1$, $6_2$, and which is integrally connected at its lower surface to an engagement projection 9 which is in turn engageable with the mating terminal accommodated in the passage 2. Said engagement projection 9 forms, together with the lid member 8 as at its front side, a shoulder $9_a$ which engages the terminal, and is provided at its lateral sides with horizontally extending lugs $9_b$ which are engageable with grooves (not shown) provided on the inner lateral walls of the housing. The rear holder is integrally connected to the housing 1 by hinges 10 which have a sufficiently long extension to bridge over from rear rims of the windows to the lower surfaces of projections and have wider roots so that it shall have a moderate resiliency. In other words, a little above the windows $6_1$, $6_2$ which are wide enough to allow the engagement projection 9 and the hinges 10 free passages therefrom and thereinto, the rear holder 7 is normally kept unless it is pressed into the window.

In the housing 1 having constructions ad described above, the terminals $3_1$, $3_2$ are retained therein and the rear holders operate to that effect as follows.

As shown in FIG. 2, the terminals $3_1$, $3_2$ inserted in the terminal passages 2 are retained therein primarily by the retainer arms $5_1$, $5_2$. When the rear holders 7 which are normally sustained above the windows $6_1$, $6_2$ by means of the resilient hinges 10, are lightly pressed down, their engagement projections 9 are locked with the housing by means of the lugs $9_b$, whereby even when leads 11 are pulled rearwardly, the terminals can not be withdrawn rearwardly since their conductor portions $3_a$ abut at rear end or engagement slot $3_d$ thereof against the shoulders $9_a$. It shall be noted in this connection that since the engagement projections share the retention of terminals in the passages with the retainers $5_1$, $5_2$, the deformation or damages of the retainers are avoided and they are retained in the passages by double lockings.

Figure 3:
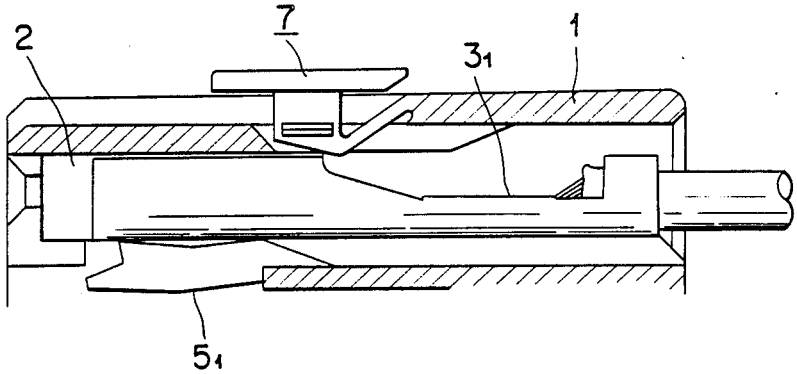
FIG. 3 is an explanatory sectional view of the housing to show how a rear holder operates in this invention.

And, as shown in FIG. 3, when the terminal $3_1$ is incompletely inserted in the passage, the engagement projection 9 abuts at its lower surface against the conductor portion $3_a$ of the terminal and can not be engaged correctly with said portion, whereby it shall readily be recognized that the terminal has not completely been inserted and its incomplete insertion can easily be prevented. In addition to this advantageous features this invention has, since the rear holders 7 of this invention can insertedly be fitted into and removed from the windows $6_1$, $6_2$ by simple and lightly pressing or lifting them vertically outisde the windows, immoderate force shall not be exerted on resilient hinges thereof and consequently they can be repeatedly used.

While in the embodiment of this invention on which the description was made above with reference to the drawings, a plurality of projections 9 are provided in series to the lower surface of the single lid 8, the lid can be eliminated or the lid can be splitted to a number correspondent to the number of projections $9_b$ so that each lid covers each window. It shall be noted also that the lugs $9_b$ for removably retaining the projections 9 to the housing can be provided at front or rear sides of the projections instead of lateral sides thereof. And, the lugs may be provided to the lids 8 instead of their projections $8_1$ if the holders 7 have the lids.

As explained above in detail, in the electrical connector housing made in accordance with this invention, its rear holder can readily and steadily operated, while incomplete insertion of terminals can certainly be prevented before such happens. And, since the rear holder is connected to the housing by the hinges connected at one end thereof to each projections and at another end to a rim of each window, the hinges can have longer extension and thereby stand for a long life of operation.

What is claimed is:

1. An electrical connector housing having passage means for accommodating at least one terminal therein, terminal latch means for latching said at least one terminal, window means opening to said passage means, a rear holder connected to the housing through an inner periphery of said window means and adapted to be fitted into said window means, said rear holder comprising projection means for engaging with said at least one terminal independently of said terminal latch means in said passage means for prevention of a rearward withdrawal movement thereof, said projection means being connected to a rim of the window means by a resilient hinge means.

2. An electrical connector housing according to claim 1, wherein said passage means includes a passage, said window means including a window, said projection means including a projection.

3. The housing as claimed in claim 2, in which said projection is provided with a lid which has a dimension to cover said window.

4. The housing as claimed in claim 2, in which said projection is provided with lugs for locking the rear holder to the housing.

5. An electrical connector housing according to claim 1, wherein said passage means includes a plurality of passages, said window means including a plurality of windows, said projection means including a plurality of projections.

6. An electrical connector housing according to claim 5, wherein said projections are provided with lugs for locking the rear holder to the housing.

7. An electrical connector housing according to claim 5, wherein said projections are provided with a common lid having a dimension to cover said windows.

8. An electrical connector housing according to claim 7, wherein a selected number of the projections are provided in series with a specific distance therebetween on a bottom surface of the common lid.

9. In an electrically insulated connector housing having at least one passage for accommodating a terminal therein which extends parallel to a longitudinal axis of the housing and having retainer means provided in the housing for the engagement with the terminal for preventing it from being withdrawn rearwardly from the passage in which it has been completely inserted; the housing comprised of a window provided in an outer circumferential wall of the housing and opened to said at least one passage; holding means, operable independently of said retainer means, disposed within said window, for lockingly engaging a part of the terminal when said terminal is completely inserted in the passage, said holding means comprising a projection of a dimension smaller than the window and connected at its lower part to a rim of the window by a resilient hinge extending from sad rim substantially in parallel with the longitudinal axis of the housing, said projection being operable from its inactive position where it is sustained by the horizontally extending hinge so as to stand vertically over and apart from the window and to its operative position where it is engaged with the part of the terminal for sharing the prevention of rearward withdrawal movements of the terminal with the retainer means by its substantially vertical downward movement accompanied with the resilient flection of the hinge of an angle of less than a right angle.

* * * * *